United States Patent [19]

Stoudt

[11] Patent Number: 5,028,031

[45] Date of Patent: Jul. 2, 1991

[54] SIGN AND FLAG HOLDER

[75] Inventor: Theodore L. Stoudt, Lake Oswego, Oreg.

[73] Assignee: Sign-Up Corporation, Portland, Oreg.

[21] Appl. No.: 510,891

[22] Filed: Apr. 18, 1990

[51] Int. Cl.[5] ..... G09F 15/00

[52] U.S. Cl. ..... 40/610; 40/612; 248/188.6; 248/538; 248/513

[58] Field of Search ..... 40/602, 610, 612, 606, 40/591, 607; 248/188.6, 188.8, 166, 538, 231.1, 624, 513, 536, 512; 403/388; 108/131

[56] References Cited

U.S. PATENT DOCUMENTS 2,669,405 2/1954 Donnelly .
2,697,018 7/1954 Georgides .
2,991,830 7/1961 Abel .
3,171,626 3/1965 Keats .
3,677,511 7/1972 Dicke .
4,309,836 1/1982 Knapp .
4,490,934 1/1985 Knapp .
4,865,287 9/1989 Stoudt ..... 248/513
4,888,894 12/1989 Brown, Jr. ..... 40/612

FOREIGN PATENT DOCUMENTS 6800395 7/1969 Netherlands .

*Primary Examiner*—Peter R. Brown
*Assistant Examiner*—Cassandra L. Hope
*Attorney, Agent, or Firm*—Grant L. Hubbard

[57] ABSTRACT

A sign support comprising a pair of pivot leg assemblies secured along the bottom on the respective sides of the sign, a receptor for a sign which removably locks the sign to the support and a flag staff support for securement to the edge of the sign are disclosed.

7 Claims, 2 Drawing Sheets

1/2

SIGN AND FLAG HOLDER

BACKGROUND OF THE INVENTION

This invention relates to sign stands for display in warning purposes, such as those used at construction sites along or near highways, construction sites in or near building projects, or in buildings where repair is taking place, in parking lots and parking structures, and in merchandising generally.

The prior art is replete with hundreds, perhaps thousands, of kinds of signs and displays, and many ingenious devices and arrangements have been provided for supporting a sign in a particular location to accomplish a particular purpose, or to overcome a particular problem. One of the problems which has plagued and continues to plague the industry is the problem of storage of signs when they are not in use and the problem of the time that it takes to set up a sign for display purposes. This problem is a severe economic burden on industries where signs are taken up and stored and used again at frequent intervals, but not subject to continuous use. In construction, for example, it is common to have to move signs around on a daily or more frequent basis. In parking lot management it is necessary to set up and store signs sometimes several times a day, and not infrequently at least once a day, as a parking lot is in use, or empties or fills, or is divided for separate uses.

Many sign stands are provided which are mounted securely and firmly to the sign and which do not readily fold, or have expensive and heavy folding mechanisms. Some sign stands, for example, are built around a circular base which may be either heavy enough to support the sign and prevent it from tipping, or may have a large enough radius to prevent the sign from tipping under influences of bumping, wind, et c. Some sign stands have various types of leg folding mechanisms.

In spite of the many efforts to solve these various problems in the industry, there remains a serious need for a light-weight, compact, easily storable sign system.

In traffic situations, such as at highway construction sites, repair sites, and the like, and sometimes in merchandising circumstances, it is highly desirable to provide a flag or a number of flags on top of the sign to catch the attention of those passing by. These flag devices are particularly valuable when the sign is used in parking lots and along highways, or where the sign is subject to prevailing wind or to wind generated by moving traffic, since the waving of the flat tends to bring instantaneous attention to the sign. The sample principle applies in certain merchandising situations where there is a natural wind or an artificially created wind current.

This invention is directed to a simple, inexpensive and yet effective and easy to operate set of mechanisms for solving these problems at low cost.

SUMMARY OF THE INVENTION

The present invention comprises a sign system and important sub-systems. The sign system comprises a generally planar sign having a bottom edge and at least one other edge having a recess formed in the plane of the sign proximate the bottom edge and a sign receptor assembly having receptor means for receiving the sign.

The sign receptor assembly preferably comprises receptor means for receiving an edge of a sign which has formed therein a recess proximate the edge of the sign which is received therein and sign latch means comprising a hook which may extend into the recess in the sign for engaging in the recess and locking the sign in the receptor means and means for moving the hook out of the recess for permitting the sign to be removed from the receptor means. The recess is preferably through the thickness of the sign, thus forming an opening or aperture through the sign.

The sign system also comprises flat staff supporting means comprising a pair of opposed generally planar plates having a first edge and a second edge. At least one of the plates has at least one recess in the first edge for receiving the end of a flag staff. At least one of the plates has formed intermediate the first and second edges a ridge extending from the plane of the plate. The plates, respectively, have formed therein least one pair of aligned apertures, at least one of the apertures extending through the ridge. Fastener means, such as a bolt and nut assembly, extend through the apertures for clamping the plates together, the first edge clamping at least one flag staff and the second edge clamping the edge of the sign.

In the preferred embodiment at least two flag staffs are provided for and the flag staff securing means comprises first and second plates, each of the plates having formed therein at least two relatively diverging flat staff receiving recesses. Preferably, at least two apertures, the apertures in the respective plates being in respective alignment are formed. The ridge is formed in the first plate and the apertures in the first plate are formed through the apex of the ridge. Two, or more, fasteners extend through the respective aligned apertures compressing the two plates toward each other thereby clamping at least two flag staffs in the respective receptacles and clamping the flag staff holder to the edge of the sign.

The sign latch means of the sign receptor assembly preferably comprises a pivotal member secured to the receptor means, and the receptor means for the sign has formed therein an opening which, in use, corresponds to the recess in the sign, and the sign latch means is so constructed and disposed that, in use, the hook normally extends into the opening in the receptor means for being engaged by the edge of the sign which is to be received in the receptor.

It is also preferred that the sign latch means of the sign receptor assembly be so constructed and disposed that in use the hook is forced by the insertion of the sign in the receptor means to permit the sign to be received therein and the hook returns to its normal position extending into the receptor means and the recess in the sign for locking the sign in the receptor means.

The receptor assembly and the flag staff holder may be used as part of the same system or may be used, independently of each other, in any system.

In one preferred embodiment, generally planar sign, which may be square, rectangular, round, or any other shape, and which has an upper edge is supported, when in use, in a sign receptor which, in turn is supported in a generally vertical position by a pair of pivot leg assemblies. One such assembly is secured along the bottom on one side of the sign receptor assembly, and the other such assembly is secured along the bottom on the other side of the sign receptor assembly. Each such assembly comprises a generally U-shaped leg having a generally linear center portion and left and right support portions extending generally in the same plane relative to each other and generally parallel to each other from the center portion, the center portion having formed therein a support locking aperture and a storage locking aperture. Leg rotation support means, which comprise elongate channel members for receiving the center portion of the leg, permit rotation of the center portion of the leg therein to thereby permit the legs to extend outwardly and/or downwardly from the sign for supporting the sign, or to lie against the sign for storage.

Leg latch means are provided for engaging either the support locking aperture or the storage locking aperture in the center portion of the leg for locking the leg either with the left and right support portions in support position extending from the sign for supporting the sign or with the left and right portions of the leg locked in a storage position substantially parallel to and adjacent the sign.

Leg latch support means support the leg locking latch and permit movement of the leg locking latch to permit the leg locking latch to engage either the support locking aperture or the storage locking aperture.

DESCRIPTION OF THE PREFERRED EMBODIMENT

Figure 1:
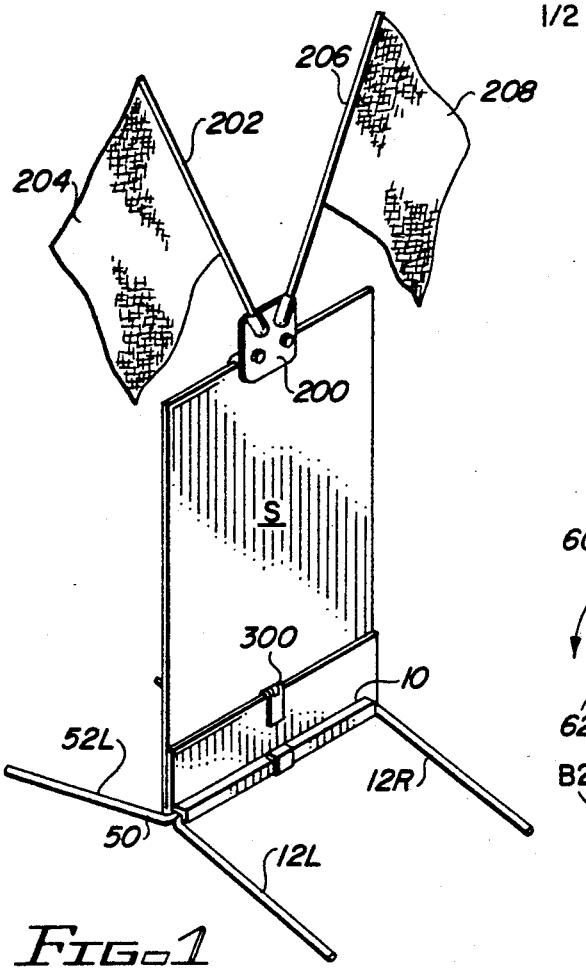
FIG. 1 is a perspective view of the sign system of the present invention.

Making reference now to the drawings, and to FIG. 1 in particular, the sign system of this invention comprises a sign S, removably secured in a base by a sign support and sign latch assembly 300, the base comprising pair of pivot leg assemblies 10 and 50, one such assembly secured along the bottom on one side of the sign support and the other such assembly secured along the bottom on the other side of the sign support. Each such assembly comprises a U-shaped leg, which may be of one unitary piece, or made up of several pieces. Ends 12L and 12R of leg 12 and one end 52L of leg 52 are shown in FIG. 1. A flat and staff holder 200 mounted to the top of the sign S holding two flag and staff assemblies 202,204 and 206,208 are also shown in FIG. 1.

Figure 2:
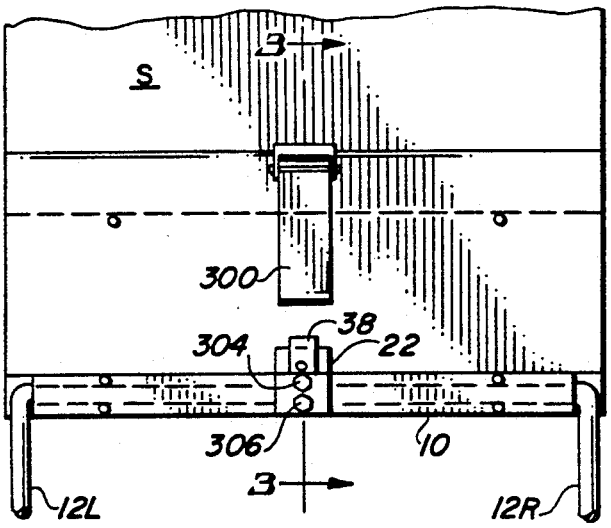
FIG. 2 is a plan view of the quick attachment-quick release mechanism for attaching and releasing a sign from the base.

The sign is shown, in the exemplary embodiments of FIGS. 1 and 2, as being generally rectangular, but it may be square, triangular, or any other shape. It is not necessary that the top be linear, as is shown in FIGS. 1 and 2, as the same kind of sign will fit over the upper edge of a round sign or a sign having a curved upper edge.

Making particular reference now to FIGS. 3–7, the sign is supported in a sign holder 300 which comprises, in the preferred embodiment, a pair of plates 310 and 312 which are vertically oriented in use and are spaced to receive the sign between them. Less than complete plates, e.g. vertical supports sufficient to hold the sign and the sign latch, may be used and would be equivalent. The plates 310 and 312 are, in the preferred embodiment, supported by a pair of opposed generally identical leg assemblies 10 and 50 by suitable means, fasteners 302 and 304, depicted as bolt and nut assemblies, and may include spacers 306 and 308 for keeping the plates 310 and 312 spaced to receive the sign. It will be immediately recognized that spacers are not required at the bottom of the plates and that weldments, rivets or any other fastener can be used and that any other leg assemblies can be used.

In an exemplary embodiment the plates, or equivalent sign-receptors, are secured together in spaced relation by, for example, one or more bolt assemblies 314, or other fasteners, which may include a spacer 316 or other means for providing a receiving slot for the sign.

A pivot support 320 is attached to or formed as part of the sign receptor for supporting a sign latch in a pivotal manner as, for example, by a pivot pin 322. A sign latch 330 is received in pivotal relation with respect to the pivot support 320. The sign latch may be secured to the pivot pin, and the pin pivotally received in the pivot support, or the sign latch may be pivotally mounted on the pin. In the preferred embodiment, the pivot support is a pair of spaced ears having aligned apertures therein pivotally receiving the pivot pin 322 to which the sign latch is secured by a weldment, or which is formed as part of the sign latch.

In the preferred embodiment the sign latch 330 is an elongate strap having one end bend to form a sign hook 332 and may include a bend 334 at the other end to maintain the major portion of the sign latch parallel to the sign receptor plates. The latter bend is, of course, not required for functionality. The sign latch, pivot means comprising the pivot pin and pivot support, and the sign hook 322 are so constructed and disposed that when a sign S having an sign aperture 340 therein is received in the sign support, between plates 310 and 312 for example, the sign hook engages in the sign aperture 340 selectively preventing removal of the sign from the sign support. The sign is removed in the converse manner, i.e. the sign latch 330 is pivoted to remove the sign hook 32 from the sign receptor slot and the sign is removed. It is convenient, though not necessary that the bottom of the sign be supported on the spacers 316.

Figure 4:
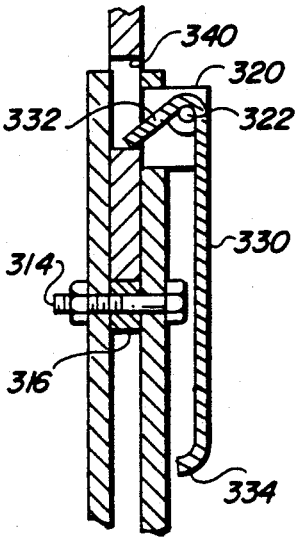
FIG. 4 is an enlarged exploded view of the sign attachment and release mechanism, showing the sign attached in the holder and base.

FIG. 4 depicts the sign support with a sign locked therein by the sign latch 330 and its hook 332.

Figure 5:
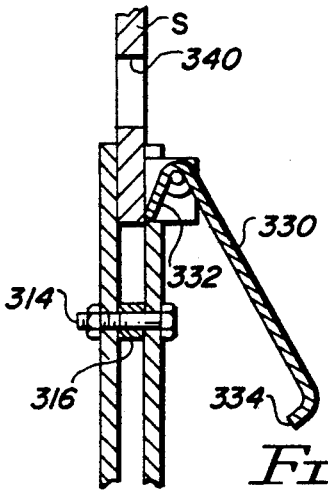
FIG. 5 is an enlarged exploded view of the sign attachment and release mechanism, showing the sign just before it is attached in the holder and base, and during removal of the sign, the positions of the components being identical in such instances.

FIG. 5 depicts the sign support with the sign partially inserted therein. FIG. 5 depicts both the insertion of the sign and the removal of the sign, as both are identical insofar as the position of the sign latch is concerned. Assume, for the present discussion, that FIG. 5 depicts the insertion of the sign. As the sign S is inserted into the receptor slot, the bottom edge of the sign forces the hook 332 of the sign latch, and the sign latch 330 to move to what is referred to as the sign latch open position. As the sign moves further into the receptor slot, the aperture 340 in the sign becomes aligned with the aperture in the plate 310 through which the hook 332 extends and the hook moves into the sign aperture 340 under force of gravity, i.e. the weight of the major portion of sign latch 330, and locks the sign in the slot, as shown in FIG. 4.

Figure 6:
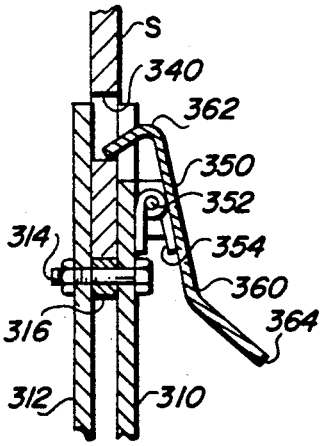
FIG. 6 is an enlarged exploded view of an alternative sign attachment and release mechanism showing the sign attached in the holder and base.
Figure 7:
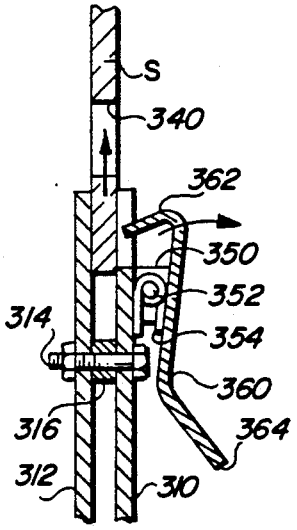
FIG. 7 is an enlarged exploded view of the alternative sign attachment and release mechanism depicted in FIG. 6, showing the sign just before it is attached in the holder and base, and during removal of the sign, the positions of the components being identical in such instances.

The sign latch mechanism of FIGS. 4 and 5 is quite adequate when the sign S is inserted downwardly into the slot. An alternative form of the sign latch is depicted in FIGS. 6 and 7 which does not rely upon gravity. In this embodiment pivot support assembly comprises one or more pivot supports 350, a pivot pin 352 and a bias mechanism such as spring 352. The sign latch 360 comprises a hook 362 which functions as described respecting hook 332, but has, in an exemplary embodiment, an outwardly extending portion 364, though the latter is not required. The bias mechanism, spring 354, applies a resilient bias between the sign latch 360 and the sign receptor mechanism, e.g. plates 310 and 312, permanently and resiliently biasing the hook 362 toward the locked position. The operation is generally the same as described, except that one must force the sign latch 360 to move, in this instance pivoting oppositely from sign latch 330, to the open position to remove the sign. The sign latch will be forced to the open position merely by insertion of the sign, as described with respect to sign latch mechanism 330.

There are, of course, many mechanisms which may be assembled, based upon the foregoing teachings, to accomplish the same purpose.

The flag support and receptor is supported by leg assemblies in the same manner as described in my copending application Ser. No. 495,722 filed Mar. 19, 1990. Briefly, the tube holder is made by bending a tube to form two generally equal-length linear tubular portions for receiving the flag staff, and cutting the center portion along the length of the tube to form a slot to receive the top of the sign, and drilling a hole through the flag holder perpendicular to the plane of the slot in the center of the V into which the holder is shaped. The tube is typically made of steel, and may be from as small as ½ to as large as 1½ inch in diameter, typically about ¾ to 1 inch in diameter. The two may, of course, be made of aluminum or any other material which is sufficiently strong and rigid to support the flag staff.

Figure 3:
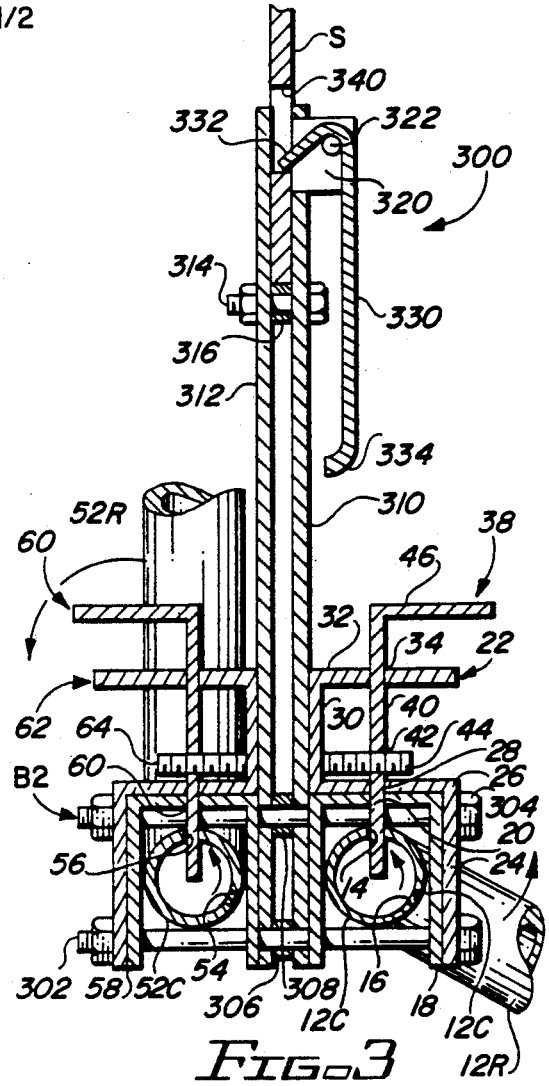
FIG. 3 is a cross-sectional view take along lines 3—3 in the direction of the arrows as shown in FIG. 2, showing in detail the structure of the leg support and pivot mechanism and the sign attachment and release mechanism.

As best shown in FIG. 3, the generally planar plates 310 and 312, which are merely exemplary, are received between a pair of pivot leg assemblies 10 and 50. One assembly 10 is secured along the bottom on one side of plate 310, and the other assembly 50 is secured along the bottom on the other side of the plate 312, the two assemblies being secured in back-to-back or mirror-image configuration relative to each other.

Each of the pivot leg assemblies comprises a generally U-shaped leg having a generally linear center portion 12C and 52C respectively, and left and right support portions 12L and 12R, in assembly 10, and 52L and 52R in assembly 50. These support portions extend generally in the same plane with respect to each other and, preferably but certainly not necessarily, are generally parallel to each other as they extend from the center portion. In some embodiments, it is desirable that the support portions extend outwardly from each other within the same plane. The center portion 12C has formed therein a support locking aperture, and the center portion 52C has formed therein a support locking aperture 54. The support locking apertures are so formed in the center portions and constructed as to receive a leg locking latch, which will be described, for being locked in an extended position to lock the legs as they extend outwardly from the sign, in opposite directions, for supporting the sign at or above a surface.

Disposed at approximately 90° or more, typically around 100° to 110°, from the support locking aperture is a storage locking aperture 16, in center portion 12C and 56 in center portion 52C. The support locking apertures are so disposed and arranged in the center portion that when the leg locking latch is received therein, the legs are locked in a storage position extending upwardly in a plane generally parallel to the plane of the sign and closely adjacent thereto. The leg 12R is shown in the support position and is locked in the support position by the leg locking latch being received in the support locking aperture. Contariwise, the leg 52R is shown in the storage position locked therein by receiving the leg locking latch in the storage locking aperture 56.

Leg rotation support means 18 and 58, respectively, each comprising elongate channel members, receive the center portion of the respective legs for rotation therein. The arrow shown inside the center portion 52C, and the arrow shown on the outside of the drawing indicate the direction of rotation of the leg from the storage position to the support position. The leg rotation support means 18 and 58 have formed therein slots 20 and 60, respectively, for receiving a leg locking latch in the manner described below. Structurally, the leg rotation supports are substantially identical.

Leg locking latch mechanisms 38 and 66, respectively, are provided for engaging the support locking aperture 14 or 54, respectively, or the storage locking aperture 16 or 56, respectively, in the center portions 12C and 52C, respectively. Leg locking latch support means 22 and 62, respectively, are provided for supporting the latches 38 and 66, respectively, in a movable relationship from the locked to an unlocked position. Leg locking latch mechanisms 38 and 66, along with stop mechanisms 44 and 64, as described below, are substantially identical in construction.

The leg locking latch support mechanism 22 is, in the preferred embodiment, a bent metal strap having a downwardly extending portion 24, a rearwardly extending portion 26 having a slot 28 formed therein, an upwardly extending portion 30 and a forwardly extending portion 32, having a slot 34 formed therein, with the slots 28 and 34 being in alignment with each other and, preferably, being approximately the same size and shape. The leg locking latch 38, having a downwardly extending portion 40, with an aperture 42 therein, extends, in use, through the slot 34 and the slot 28. A set screw or other stop mechanism 44, is, in the preferred embodiment, received in the aperture 42 simply to prevent loss of the latch. The stop mechanism 44 permits the leg locking latch to move from a locked position to an unlocked position wherein the leg locking latch mechanism is lifted to remove the leg locking latch from the aperture in the center portion of the respective legs. The leg locking latch cannot be removed, however, because of the stop mechanism 44. A handle 46 is provided for convenience in operating the latch.

The leg locking latch 38 extends, when in the locked position, through the slots 34 and 28 in the latch-holding mechanism 22 and through the slot 20 in the leg rotation support means and into the slot 14, which is the support locking aperture, for locking the leg in the support position. When it is desired to fold the sign stand up, the leg locking latch 38 is lifted until the stop mechanism 44 engages the bottom of the portion 34 of the leg locking latch support means 22, at which time the bottom of the leg locking latch remains in the slot 28 and the slot 20, but not in the aperture 14. In this position, the leg 12 can be rotated, the portion 12C turning or rotating within the leg rotation support means 18, as shown in the arrow, so that the leg will ultimately reach the storage position, at which time the leg locking latch locking means can be received in the aperture 16.

It is not necessary in practice to provide a locking aperture 16 to lock the aperture in the storage position, but it is a convenience.

The leg locking latch mechanism 66 and leg locking latch support mechanism 62 are identical to but mounted in a reverse or mirror-image relationship with respect to the leg locking latch 38 and leg locking latch support mechanism 22. The pivot leg assembly 50 operates in an identical manner to that just described, except to the direction of rotation of the center portion 52C.

In one embodiment, the legs are formed of steel or aluminum tubing, from about ¾ to about 1¼ inches diameter and extend from 1½ to 3 feet outwardly from the sign, depending upon the size of the size and the degree of stability required. Obviously, the length of the legs can be varied to meet any particular support requirements. Leg extensions can be used if a particularly demanding circumstance is met. The legs can be formed as telescoping rods, for example, to be extended at will to permit the different degrees of support with simple storage and ease of use, and are also quite usable in small or crowded spaces.

The rest of the mechanism, the leg locking latch mechanism included, is generally made of steel from about 3/32 inch to about ¼ inch in thickness, depending upon the size of the sign which is to be supported and the particular support criteria. For small signals, ⅛-inch wall tubing and ⅛-inch thick steel is quite adequate. These mechanisms may, of course, be formed of aluminum, or even of titanium, if ultra light weight is required. Generally speaking, however, the greatest economy is accomplished using steel tubing and steel plates as the basic construction material.

Figure 9:
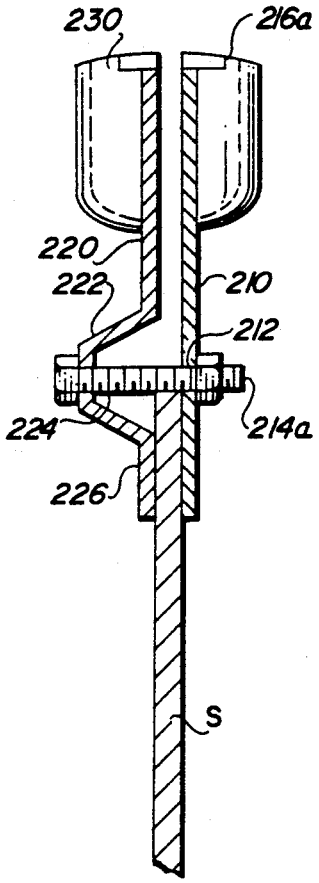
FIG. 9 is a side cross-sectional view of the flag and staff holder, taken substantially along lines 9—9 in the direction of the arrows as shown in FIG. 8.
Figure 8:
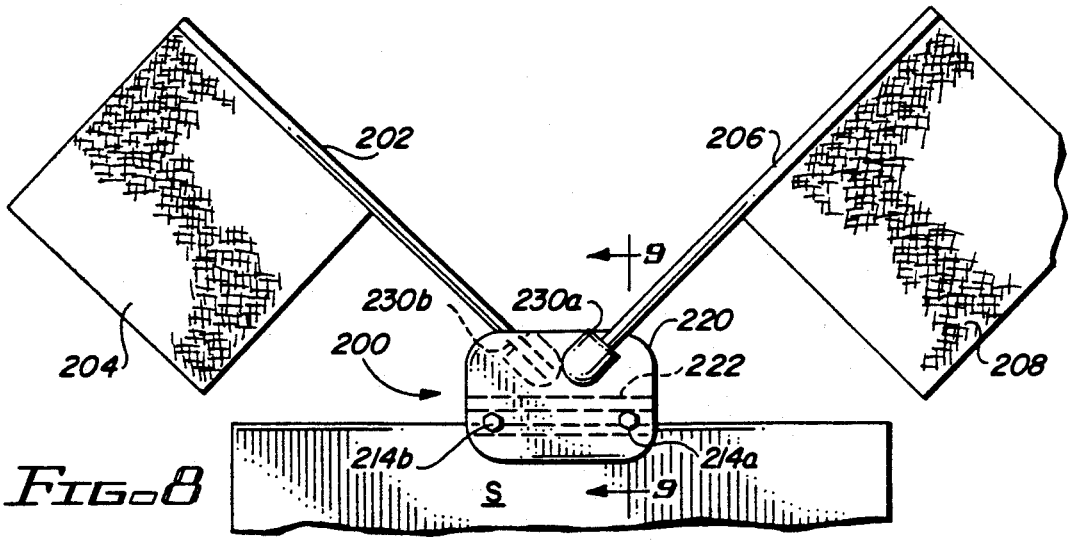
FIG. 8 is an enlarged plan view of the flag and staff holder of this invention positioned on top of the sign.

Referring now go FIGS. 8 and 9, an improved flag and staff holder is provided which may be clamped to the top or sides of a sign of virtually and shape. The flag and staff clamp 200 is, in the exemplary embodiment, configured to clamp to the edge of a sign and support two staffs 202 and 206 which carry flags 204 and 208 respectively.

The flag staff holder comprises a first plat 210 which may be generally flat. The flat plate has formed therein at least one aperture 212 for receiving a fastener, such as bolt assembly **214*a*, and, in the preferred form, has formed there one or more recesses 216, one of which is shown in FIG. 9 at 216*a***, for receiving the end of a flag staff. The recess is, in the preferred embodiment, so constructed and formed as to receive slightly less than one-half the diameter of an end a cylindrical staff.

The clamp comprises a mating plate 220 which comprise a rib 222 through which one or more apertures 224 or formed for receiving the fastener, bolt and nut assembly 214. The lower end, as depicted in FIG. 9, of the mating plate 220 is co-planer with all of the plate except for the rib 22 and for one or more flag staff receiving recesses 230, two of which **230*a* and 230*b* are shown in FIG. 8, which are mirror images of, aligned with and substantially identical to the corresponding recesses 216 in plate 210**.

Still referring to FIGS. 8 and 9, it will now be clear that the flag staff holder is suitable for being clamped on the edge of any sign and for holding one or more flag staffs to the sign. The staff or staffs are inserted into the respective recesses, the flag staff holder is slipped over the edge of the sign between the two plates and the bolt, or other fastener, is tightened clamping the holder to the sign and the staffs in the holder in one simple quickly executed operation.

There are, of course, many mechanical variations which can be made to the flag staff holder which is shown as exemplary without departing from the concept of the invention. For example, wing nuts on the bolts may provide significant advantages in use but also require greater storage space. The rib 222 need not, of course, be continuous across the plate, but rather may be simply an protuberance or boss through which the respective bolt holes are formed. Both plates may be identical, i.e. both may have a rib or equivalent protuberances, though this is an unnecessary increase in manufacturing cost. The flag staff recess may be formed entirely in one of the plates simply by increasing its size to receive the majority of the staff, the other plate being flat and clamping against one side of the end of the staff inserted therein.

The sign may be flexible or rigid, so long as it is sufficiently planar, or approximately planar, so as to be capable of being mounted between the pivot log assemblies.

It will be apparent from the foregoing description and the drawings that a sign system is provided which is light in weight, is easily disassembled as to the flag holder, if desired, and is stored and equally easily unfolded and set up for use. The entire sign, in the folded position, may be stacked, hung or placed in a flat container for long-term storage, or handled in any manner with minimum damage to the sign and with minimum space occupancy.

All these advantages are accomplished at low cost and with high efficiency in the time required for setting up and storing the signs.

INDUSTRIAL APPLICATION

This invention has application in the traffic control and direction and in the merchandising display industries.

What is claimed is:

1. A sign support comprising:

a sign receptor assembly having first and second sides, at top for receiving a sign and a bottom for being supported;

a pair of pivot leg assemblies (10, 50), one such assembly secured along the bottom of one side of the receptor assembly and the other such assembly secured along the bottom on the other side of the receptor assembly, each such assembly comprising:

a leg having a generally linear center portion (12C, 52C) and left and right support portions (12L,52L,12R,52R) extending generally in the same plane from the center portion, the center portion having formed therein at least one aperture;

leg rotation support means (18,58) for receiving the center portion of the leg for rotation therein;

leg locking latch means (38,66) for engaging the aperture (14,54) in the center portion of the leg for locking the leg with the left and right support portions extending from the sign for supporting the sign; and leg locking latch support means (22, 62) for supporting the leg locking latch and permitting movement of the leg locking latch from a position locking the leg with the left and right support portions extending from the sign to a position permitting the center portion to rotate in the leg rotation support means to a position wherein the legs lie substantially against the sign.

2. The sign support of claim 1 wherein the center portion of the leg (12C,52C) has formed therein a second aperture for receiving the leg locking latch means and wherein the leg locking latch means and second aperture are so formed and constructed that when the leg locking latch means is received in the second aperture the left and right portions of the leg (12L, 52L, 12R, 52R) are locked in a storage position substantially parallel to and adjacent the sign.

3. The sign support of claim 1 wherein the sign receptor assembly comprises:

receptor means for receiving an edge of a sign which has formed therein a recess proximate the edge of the sign which is received therein; and sign latch means comprising a hook which may extend into the recess in the sign for engaging in said recess and locking the sign in the receptor means and means for moving the hook out of said recess for permitting the sign to be removed from the receptor means.

4. The sign support of claim 3 wherein the sign latch means comprises a pivotal member secured to the receptor means.

5. The sign support of claim 3 wherein the receptor means has formed therein an opening which, in use, corresponds to the recess in the sign, and wherein the sign latch means is so constructed and disposed that, in use, the hook normally extends into the opening in the receptor means for being engaged by the edge of the sign which is to be received in the receptor means.

6. The sign support of claim 5 wherein the sign latch means is so constructed and disposed that in use the hook is forced by the insertion of the sign in the receptor means to permit the sign to be received therein and the hook returns to its normal position extending into said receptor means and the recess in the sign for locking the sign in the receptor means.

7. The sign support of claim 6 wherein the sign latch means comprises a pivotal member secured to the receptor means.

* * * * *